US006417816B2

(12) United States Patent
Sadler et al.

(10) Patent No.: US 6,417,816 B2
(45) Date of Patent: Jul. 9, 2002

(54) DUAL BAND BOWTIE/MEANDER ANTENNA

(75) Inventors: Robert A. Sadler, Durham, NC (US); John M. Spall, Bedford, TX (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/766,166

(22) Filed: Jan. 19, 2001

Related U.S. Application Data

(63) Continuation of application No. 09/377,019, filed on Aug. 18, 1999, now abandoned.

(51) Int. Cl.[7] ..... H01Q 9/28
(52) U.S. Cl. ..... 343/795; 343/702
(58) Field of Search ..... 343/700 MS, 702, 343/713, 795, 797, 829, 846; H01Q 1/24, 9/28

(56) References Cited

U.S. PATENT DOCUMENTS

| | | | | | |
|---|---|---|---|---|---|
| 3,369,245 | A | * | 2/1968 | Rea | 343/795 |
| 3,716,861 | A | * | 2/1973 | Root | 343/741 |
| 4,038,662 | A | | 7/1977 | Turner | |
| 4,287,518 | A | * | 9/1981 | Ellis | 343/700 MS |
| 4,360,741 | A | * | 11/1982 | Fitzsimmons et al. | 307/151 |
| 4,571,595 | A | * | 2/1986 | Phillips et al. | 343/745 |
| 4,860,019 | A | * | 8/1989 | Jiang et al. | 343/795 |
| 5,532,708 | A | | 7/1996 | Krenz et al. | |
| 5,563,616 | A | | 10/1996 | Dempsey et al. | |
| 5,583,521 | A | | 12/1996 | Williams | |
| 5,764,195 | A | * | 6/1998 | Colclough et al. | 343/797 |
| 5,867,131 | A | | 2/1999 | Camp, Jr. et al. | |
| 5,936,587 | A | * | 8/1999 | Gudilev et al. | 343/752 |
| 5,986,609 | A | * | 11/1999 | Spall | 343/702 |
| 6,078,288 | A | * | 6/2000 | Adams et al. | 342/372 |

FOREIGN PATENT DOCUMENTS

| | | | |
|---|---|---|---|
| EP | 0642189 | A | 3/1995 |
| EP | 0757405 | A1 | 2/1997 |
| GB | 2325091 | A | 11/1998 |
| JP | 60240201 | | 11/1985 |
| WO | WO85/02719 | | 6/1985 |

OTHER PUBLICATIONS

Nesic, Aleksander; Radnovic, Ivana; Brankovic, Veselin; "Ultrawideband Printed Antenna Array for 60 GHz Frequency Range," IEEE, 1997, pp. 1272–1275.

* cited by examiner

*Primary Examiner*—Tho Phan
(74) *Attorney, Agent, or Firm*—Coats & Bennett, P.L.L.C.

(57) ABSTRACT

An internal dipole bowtie/meander antenna for a mobile terminal is capable of operating in two distinct RF bands. The antenna includes a resonating element and a ground element positioned on opposite sides of a dielectric material. The dielectric material is positioned generally perpendicular to a ground plane of the antenna. Tuning elements may be added to vary the coupling of the antenna elements to the ground plane.

40 Claims, 6 Drawing Sheets

DUAL BAND BOWTIE/MEANDER ANTENNA

This application is a continuation of Application Ser. No. 09/377,019, filed Aug. 18, 1999, now abandoned.

FIELD OF THE INVENTION

The present invention relates to mobile terminals for use in analog and digital-based cellular communication systems, and, in particular, to an improved antenna configuration for dual-band operation.

BACKGROUND OF THE INVENTION

Although experiments have been performed from ancient history forward in the realm of electricity and magnetism, it was not until the early 1900s that the electromagnetic spectrum was harnessed for commercial communication by Guglielmo Marconi and his antennas. As is known to those skilled in the art of communications devices, an antenna is a device for transmitting and/or receiving electromagnetic signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna is described in terms of gain.

At its simplest, electromagnetic fields or waves originate with time-varying electrical currents. The focus of antenna design thus can be boiled down to producing the right currents when desired. While Marconi used huge antenna arrays with seventy-meter towers, operating at wavelengths of approximately 2000 to 20,000 meters, modem antennas typically correspond to a mathematically ideal antenna known as the half-wave dipole antenna. That is, the antenna's total length corresponds to a length equal to half the wavelength of the operating frequency.

While referred to as half-wave antennas, the physical dimensions of the antennas may be much shorter than a half-wavelength at an operating frequency. This is effectuated by creating an effective electrical length of the antenna equal to a half-wavelength. This electrical length is dictated by the resistance, inductance and capacitance (collectively the impedance) of the conductors used to form the antenna. The elements of the impedance are functions of the physical dimensions of the conductors used to form the antennas as well as functions of frequency. The resulting impedance is made up of a real part (the radiation resistance) and an imaginary part (the reactance). The reason half-wave dipole antennas are popular is due, in part, to the fact that the imaginary part of the impedance of the antenna disappears when the antenna is approximately a half-wavelength. Such antennas are said to be resonant.

Another important factor in antenna design is the Voltage Standing Wave Ratio (VSWR), which relates to the impedance match of an antenna feed point with the impedance of a feed line or transmission line of a communications device, such as a radiotelephone. To radiate radio frequency (RF) energy with minimum loss, or to pass along received RF energy to a receiver with minimum loss, the impedance of an antenna should be matched to the impedance of the transmission line or feeder.

Since Marconi's time, the use of antennas in everyday life has exploded. Antennas are now ubiquitous, begin present in radios, telephone, televisions, and many other domestic and commercial devices. Of particular interest are mobile communications terminals. Mobile terminals, and especially mobile telephones and headsets, are becoming increasingly smaller. These terminals require a radiating element or antenna for radio communications. There are presently four frequency stages set aside by the communications authorities as appropriate channels which are commonly used to effectuate mobile radio communications, namely AMPS (824–894 MHz); GSM900 (880–960 MHz); PCS (1850–1900 MHz); and DCS (1710–1880 MHz). A good antenna is designed to operate at least over the entire length of one of the designated frequency ranges. It is preferable to have an antenna which operates over two of the designated channels, such antennas commonly being referred to as dual-band antennas. Many examples exist of single and dual-band antennas.

Conventionally, antennas for such hand held terminals, whether single or dual band, are attached to and extend outwardly from the terminal's housing. These antennas are typically retractably mounted to the housing so that the antenna is not extending from the housing when the terminal is not in use. With the ever decreasing size of these terminals, the currently used external antennas become more obtrusive and unsightly, and most users find pulling the antenna out of the terminal housing for each operation undesirable. Furthermore, these external antennas are often subject to damage during manufacture, shipment, and use. The external antennas also conflict with various mounting devices, recharging cradles, download mounts, and other cooperating accessories.

Well known in the art as a result of the experiments of Brown and Woodward is the bowtie antenna. In its basic embodiment, the bowtie antenna includes a rectangular dielectric material with a longitudinal axis. Triangular shaped conductors are disposed on opposite sides of the dielectric material and extend from the center of the longitudinal axis outwardly towards the opposing ends of the rectangular shape. The bow tie antenna is a dipole antenna.

Also known in the antenna art is a meander antenna, which is structured somewhat similarly and is likewise a dipole. The meander antenna includes a rectangular dielectric material with a longitudinal axis and a pair of sinuous, relatively narrow conductors disposed on opposite sides of the material which extend from the center of longitudinal axis outwardly towards the opposing ends of the rectangular shape. The sinuous shapes are rectilinear and extend laterally across the rectangular shape. The meanders behave differently at different frequencies. At lower frequencies, such as 800 MHz bands, the electrical length of the radiating elements is typically the longest. At mid-range and high frequencies, such as 1500 and 1900 MHz bands, the electrical length of the radiating elements becomes shorter. At the higher frequencies, the wavelength becomes smaller and this reduces the effect of the meander, because the energy can jump over the oscillations of the meanders.

The meander antenna is also a dual-band antenna. Commonly owned application Ser. No. 09/089,433 describes a multiband combination bowtie-meander-dipole antenna for a cellular telephone, and is incorporated herein by reference.

As phone designs become increasingly smaller, antennas inevitably are brought closer to the ground plane within the phone. As antennas are brought closer to the ground plane, typically the printed circuit board (PCB) of the phone, antennas in general, and the bowtie and meander antennas in particular, begin to lose their effectiveness. It has been discovered that the effective bandwidth of the antenna is narrowed as the antenna is brought closer to the ground plane of the antenna. Also, tuning of the resonance frequencies becomes problematic due to the strays and parasitics caused by the antenna's close proximity to the ground plane. The conventional approaches of using extra traces and tuning elements may not provide sufficient bandwidth in both bands of operation in many situations. Also, lumped elements such as capacitors and inductors do not adequately eliminate strays and parasitics.

Additionally, the bowtie-meander antenna suffers a further problem not experienced by other antennas as it is brought close to the ground plane. Not only does the bandwidth narrow at the lower frequency, but also the resonance at the high band disappears, thus causing a dual band antenna to change into a single band antenna. In localities where single band operation is acceptable, the loss of a frequency band may not be a large problem, but consumers now expect their radio telephones to operate on a plurality of systems, such operations requiring the use of multiple frequency bands.

Accordingly, there remains a need for a dual-band antenna that will operate effectively in two operating bands even when the antenna is brought in close proximity to the ground plane of the phone.

SUMMARY OF THE INVENTION

The present invention provides an internal antenna for mobile terminals that provides performance comparable with externally mounted antennas, even when placed in close proximity to the ground plane. The antenna comprises a dielectric substrate oriented generally perpendicularly to a ground plane and two radiating elements arranged in a dipole configuration. The radiating elements are disposed on opposing surface of the dielectric substrate. The antenna may use the printed circuit board of the mobile terminal as the ground plane. Alternatively, the antenna may have a ground plane oriented perpendicularly to the printed circuit board. Orienting the antenna perpendicular to the ground plane allows the antenna to resonate at two or more different frequencies.

The radiating elements preferably include a bowtie element and a meander element having a plurality of oscillations. The bowtie elements are disposed in a center portion of the substrate. The meander elements extend outward from the bowtie elements toward opposite ends of the substrate. The antenna may be tuned to the desired frequency bands by adding parasitic tuning elements by varying the length, width and shape of the radiating elements, by varying the thickness or dielectric constant of the substrate, by varying the spacing of the antenna from the ground plane or by a combination thereof.

An advantage of the present invention is that it allows the design engineer to match the antenna to a Voltage Standing Wave Ratio (VSWR) of approximately 2:1 in two distinct operating bands (typically the 900 MHz and 1800 MHz bands) even at the band edges. This VSWR allows the antenna to obtain broad bandwidth in both frequency bands of operation and reduces loss of gain due to mismatch of the VSWR. No prior art antennas have been able to obtain these advantages in an antenna in such close proximity to the ground plane.

DETAILED DESCRIPTION OF THE INVENTION

Figure 1:
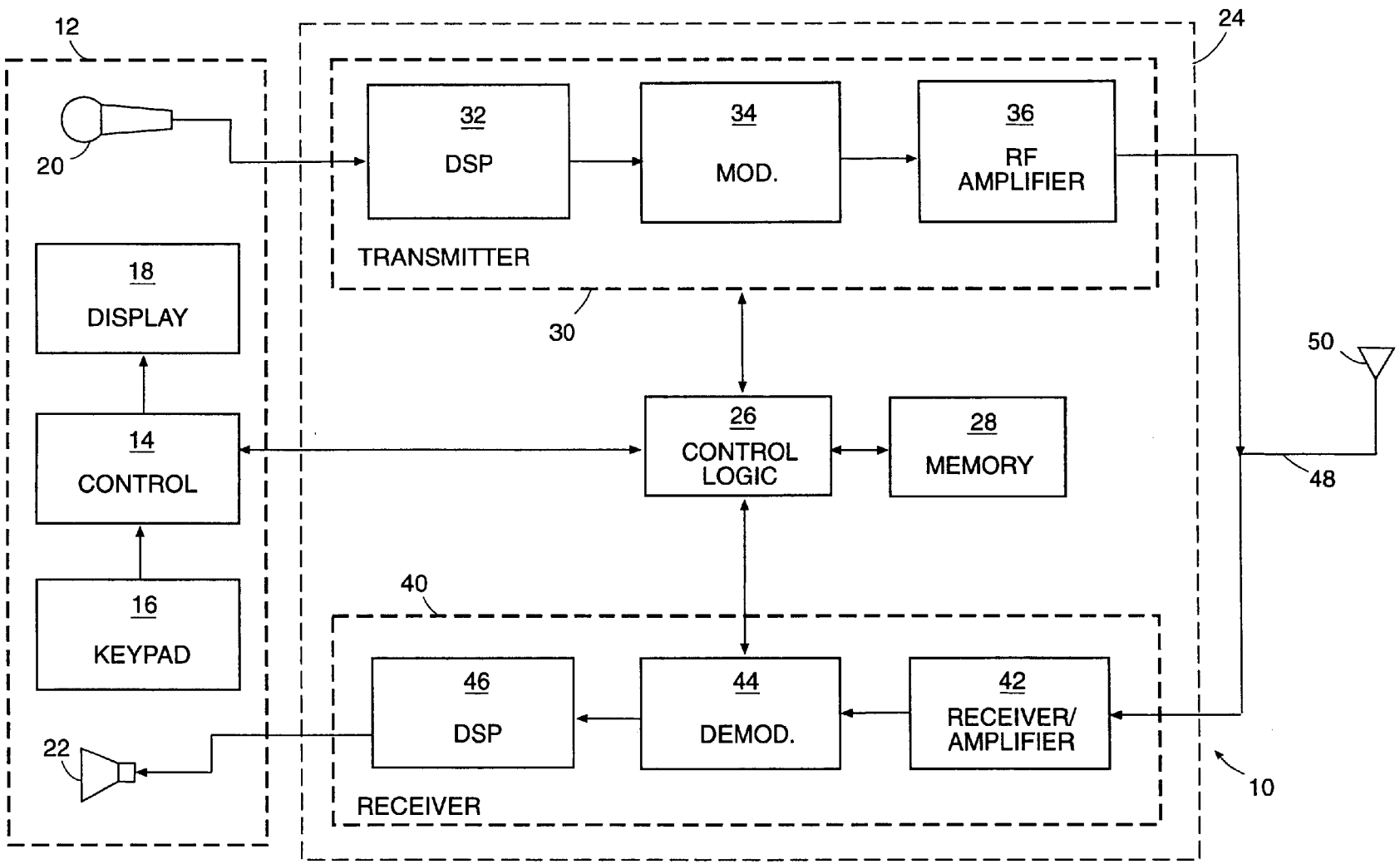
FIG. 1 is a functional block diagram of a cellular telephone constructed in accordance with the present invention.

Referring now to the drawings, and particularly to FIG. 1, a mobile communication device, such as a cellular telephone, is shown and indicated generally by the numeral 10. Mobile telephone 10 is a fully functional radio transceiver capable of transmitting and receiving digital and/or analog signals over an RF channel according to known standards, such as Telecommunications Industry Association (TIA), IS-54, and IS-136. The present invention, however, is not limited to cellular telephones, but may also be implemented in other types of mobile communication devices including, without limitation, pagers and personal digital assistants.

Figure 3:
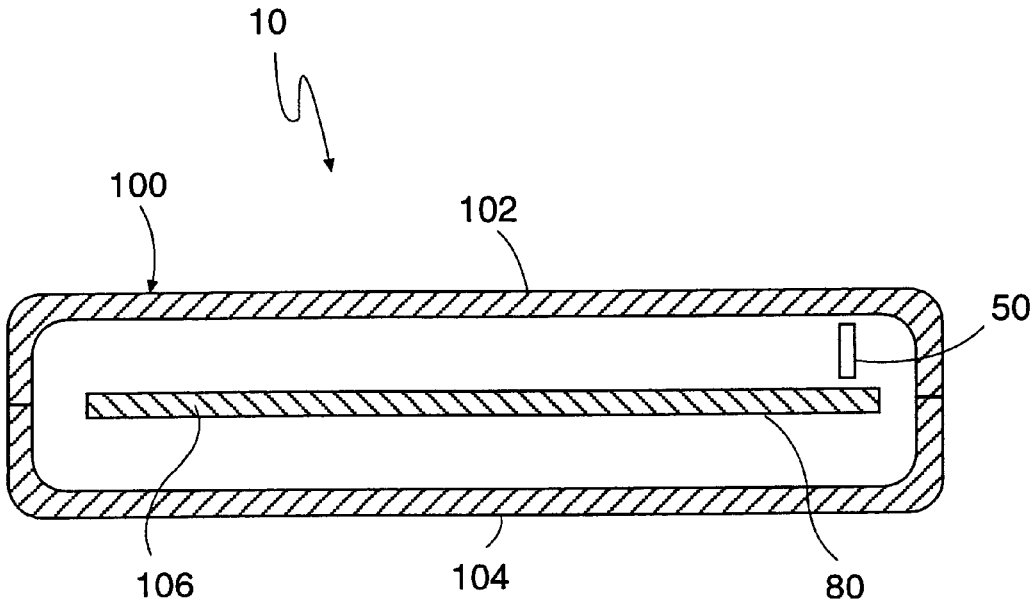
FIG. 3 is a transverse cross-section view of the cellular telephone.
Figure 4:
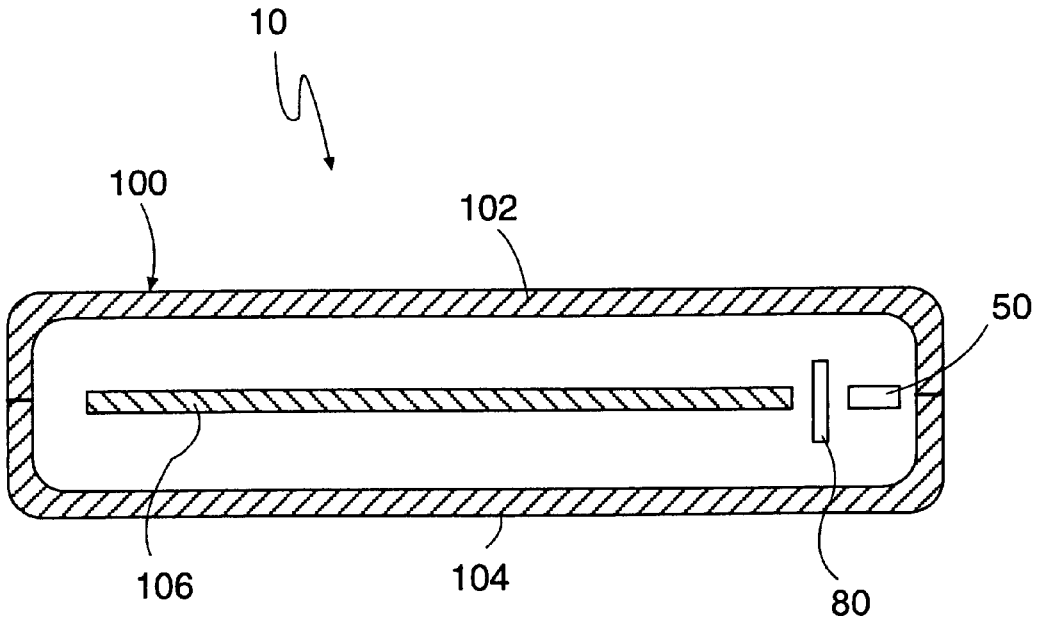
FIG. 4 is a transverse cross-section view of the cellular telephone showing an alternate placement of the antenna of the present invention.

The mobile telephone 10 includes an operator interface 12 and a transceiver unit 24 contained in a housing 100 including a front cover 102 and a back cover 104 (FIGS. 3–4). Users can dial and receive status information from the mobile telephone 10 via the operator interface 12. The operator interface 12 consists of a keypad 16, display 18, microphone 20, and speaker 22. The keypad 16 allows the user to dial numbers, enter data, respond to prompts, and otherwise control the operation of the mobile telephone 10. The display 18 allows the operator to see dialed digits, call status information, messages, and other stored information. An interface control 14 interfaces the keypad 16 and display 18 with the telephone's control logic 26. The microphone 20 and speaker 22 provide an audio interface that allows users to talk and listen on their mobile telephone 10. Microphone 20 converts the user's speech and other sounds into audio signals for subsequent transmission by the mobile telephone 10. Speaker 22 converts audio signals received by the mobile telephone 10 into audible sounds that can be heard by the user. In general, the microphone 20 and speaker 22 are contained in the housing of the mobile telephone 10. However, the microphone 20 and speaker 22 can also be located in a headset that can be worn by the user.

The transceiver unit 24 comprises a transmitter 30, receiver 40, and antenna assembly 50. The transceiver circuitry or radio communications circuit is typically contained on a printed circuit board 106 (FIGS. 3–4) disposed in the phone's housing 100. The transmitter 30 includes a digital signal processor 32, modulator 34, and RF amplifier 36. The digital signal processor 32 converts analog signals from the microphone 20 into digital signals, compresses the digital signal, and inserts error-detection, error-correction, and signaling information. Modulator 34 converts the signal to a form that is suitable for transmission on an RF carrier. The RF amplifier 36 amplifies the signal to a suitable power level for transmission. In general, the transmit power of the telephone 10 can be adjusted up and down in two decibel increments in response to commands it receives from its serving base station. This allows the mobile telephone to only transmit at the necessary power level to be received and reduces interference to nearby units.

The receiver 40 includes a receiver/amplifier 42, demodulator 44, and digital signal processor 46. The receiver/amplifier 42 contains a band pass filter, low level RF amplifier, and mixer. Received signals are filtered to eliminate side bands. The remaining signals are passed to a low-level RF amplifier and routed to an RF mixer assembly. The mixer converts the frequency to a lower frequency that is either amplified or directly provided to the demodulator 44. The demodulator 44 extracts the transmitted bit sequence from the received signal. The digital signal processor 46 decodes the signal, corrects channel-induced distortion, and performs error-detection and correction. The digital signal processor 46 also separates control and signaling data from speech data. The control and signaling data are passed to the control logic 26. Speech data is processed by a speech decoder and converted into an analog signal which is applied to speaker 22 to generate audible signals that can be heard by the user.

The control logic 26 controls the operation of the telephone 10 according to instructions stored in a program memory 28. Control logic 26 may be implemented by one or more microprocessors. The functions performed by the control logic 26 include power control, channel selection, timing, as well as a host of other functions. The control logic 26 inserts signaling messages into the transmitted signals and extracts signaling messages from the received signals. Control logic 26 responds to any base station commands contained in the signaling messages and implements those commands. When the user enters commands via the keypad 16, the commands are transferred to the control logic 26 for action.

The antenna 50 is operatively connected by a conventional transmission line 48 to the transmitter 30 and receiver 40 for radiating and receiving electromagnetic waves. Electrical signals from the transmitter 30 are applied to the antenna 50 which converts the signal into electromagnetic waves that radiate out from the antenna 50. Conversely, when the antenna 50 is subjected to electromagnetic waves radiating through space, the electromagnetic waves are converted by the antenna 50 into an electrical signal that is applied to the receiver 40. Suitable transmission lines 48 may include coaxial cable, typically including a center conductor, an internal dielectric material, an outer conductor and having a SMA-MALE connector (not shown) as is well understood in the art. Typically the outer conductor acts as a ground conductor and the inner conductor as the radiating conductor. Other conventional transmission lines are also appropriate and within the scope of the present invention.

In a hand-held mobile telephone, the antenna 50 is typically an integral part of the mobile telephone 10. Commonly, an antenna for a mobile telephone 10 of the prior art comprises an external quarter-wavelength rod antenna. One purpose of the present invention is to eliminate this type of external rod antenna and provide an antenna that can be disposed internally within the phone's housing.

Figure 2:
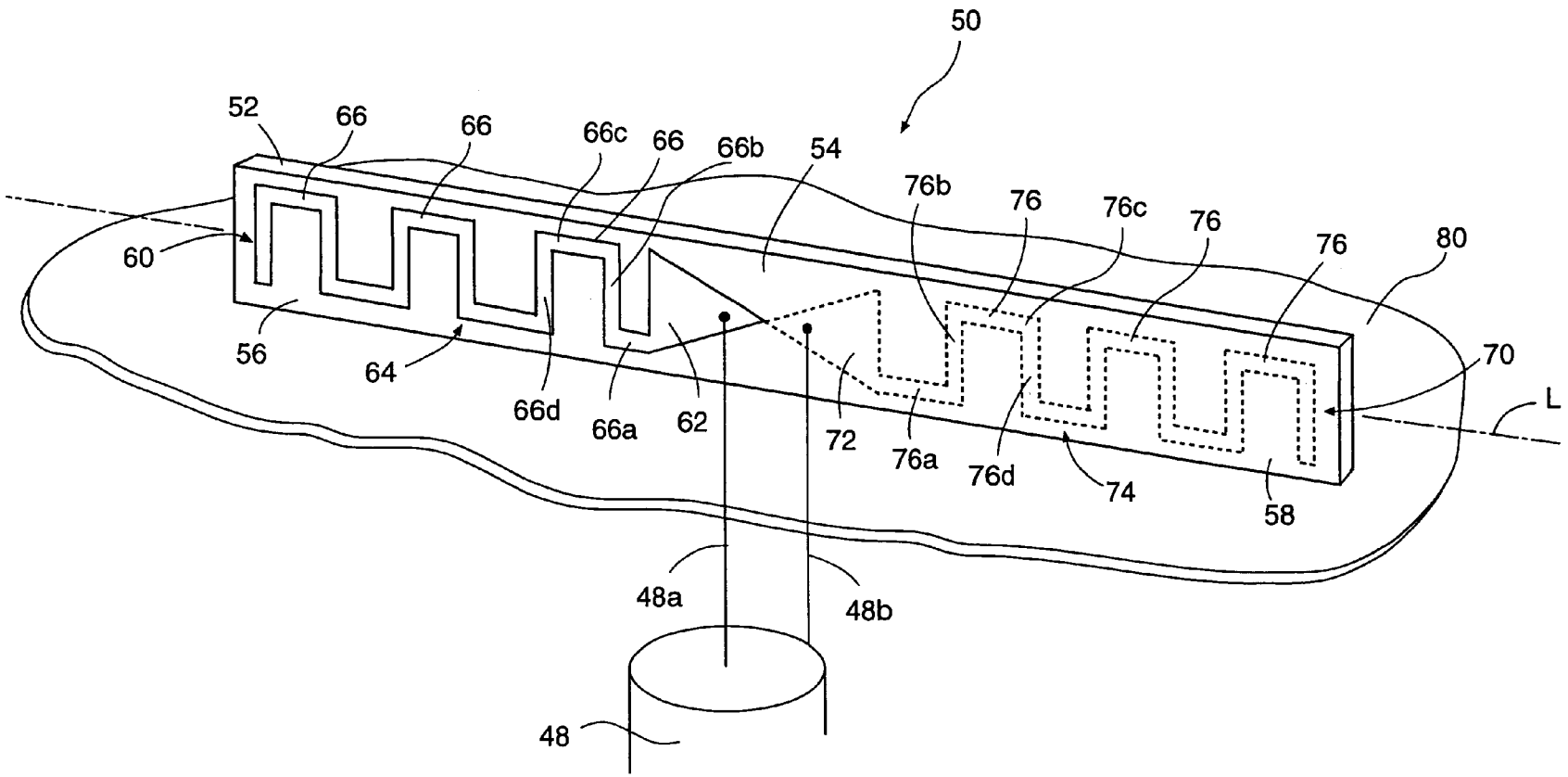
FIG. 2 is a perspective view of the antenna element of the present invention removed from the cellular telephone.

Referring now to FIG. 2 the antenna 50 of the present invention is shown in more detail. The antenna 50 is generally planar in form and is oriented generally perpendicular to a ground plane 80. The antenna 50 comprises a planar substrate 52 made of a dielectric material, such as FR4, and two opposing radiating elements, referred to herein as the resonating element 60 and ground element 70. The planar substrate 52 has an elongated rectilinear form that defines a longitudinal axis L. It includes a central portion 54 and opposing end portions 56, 58.

The resonating element 60 and ground element 70 are arranged in a dipole configuration. The antenna elements 60, 70 are disposed on opposite surfaces of the dielectric substrate 52 and extend in opposite directions from the center portion 54 of the substrate 52. A signal is transmitted between the transceiver 24 (FIG. 1) and the antenna 50 by a transmission line 48, which includes a ground feed 48*b* and a main feed 48*a* . The ground feed 48*b* of the transmission line 48 connects to the ground element 70. The main feed 48*a* of the transmission line 48 connects to the resonating element 60.

The resonating element 60 includes a triangular bowtie section 62 which forms half of a bowtie antenna. Electrically connected to the bowtie section 62 is a meander section 64 which extends generally along the longitudinal axis L of the antenna 50 from the bowtie section 62 towards one end of the antenna 50. The meander section 64 includes a plurality of oscillations generally denoted by the number 66. While the oscillations 66 shown in the disclosed embodiment are rectilinear in form, other shapes may also be used including sinuous oscillations, triangular oscillations, and trapezoidal oscillations. Therefore, the following description is only meant to be exemplary and not limiting.

Each oscillation 66 comprises a first longitudinal section 66*a*, a first transverse sections 66*b*, a second longitudinal segment 66*c*, and a second transverse section 66*d*. The first longitudinal segment 66*a* is located adjacent the lower or inward edge of the antenna 50. The inward edge is the edge closest to the ground plane 80. Second longitudinal segment 66*c* is positioned adjacent the outward or upper edge of the antenna 50. The outward edge is the edge furthest from the ground plane 80. Transverse segments 66*b*, 66*d* extend generally perpendicular to the longitudinal axis L of the antenna 50. Transverse segment 66*b* connects longitudinal segments 66*a*, 66*c*. Transverse segment 66D connects longitudinal segment 66*b* to the next oscillation 66, if any. The oscillations 66 oscillate about the longitudinal axis L in a plane generally normal to the ground plane 80. In this example, the meander section 64 is uniform in width and thickness throughout its entire length. Also, the oscillations 66 are evenly spaced along the length of the meander section 64, but could be non-uniform or irregular as will be described in more detail below.

In the embodiment of FIG. 2, the ground element 70 is simply a mirror image of the resonating element 60. The ground element 70 includes a bowtie section 72 and a meander section 74. The meander section 74 includes a plurality of oscillations 76 with longitudinal segments 76*a*, 76*c*, and transverse segments 76*b*, 76*d*. The ground element 70 in this embodiment is symmetrical with the resonating element 60, though non-symmetrical elements are within the scope of the invention. In fact, one way of tuning the antenna 50, to be discussed in more detail below, is to use asymmetrical or non-uniform elements 60, 70.

The antenna elements 60, 70 are formed from a suitable conductor, such as copper. Copper is a preferred conductor because it is easily applied to the dielectric substrate 52 in the form of copper tape as is well known in the art. Typically, the thickness of the copper tape is between about 0.5 ounces (oz.) and about 1.0 oz. copper. As is well known, the copper tape would be positioned over the entire length of substrate 52, and portions excised, leaving only the desired shape for the antenna elements. In this manner a continuous, antenna elements 60, 70 of any shape can be easily formed.

During operation, the oscillations 66, 76 control the perceived electrical length of the meander section 64, 74 of the antenna 50. At higher frequencies, the radiating or received energy leaps over the non-conducting parts of the antenna 50 and the electromagnetic field perceives an electrically short antenna 50. Thus, at higher frequencies, the number of oscillations 66, 76 directly effects the perceived electrical length of the antenna 50. While only four oscillations 66, 76 are shown on each antenna element 60, 70, it is within the scope of the invention to vary the number of oscillations to achieve a desired electrical length.

FIGS. 3 and 4 illustrate the placement of the antenna 50 in relation to the other components of the phone 10. The phone 10 includes a housing 100 having a front cover 102 and a back cover 104. A printed circuit board 106 is positioned within the housing 100. The antenna 50 is positioned within housing 100 along one side of the printed circuit board 106. In conventional cellular telephones, the printed circuit board 106 acts as a ground plane for numerous electrical components positioned within the housing 100, and especially those components positioned on the printed circuit board 106. The antenna 50 of the present invention may also use the circuit board 106 of the phone as a ground plane 80 as shown in FIG. 3. In this case, the antenna 50 is oriented generally perpendicular to circuit board 106. However, this arrangement increases the thickness (compare for example FIGS. 3 and 4) of the mobile telephone. Alternatively, and more preferably, the ground plane 80 of the antenna may be positioned along one edge of the circuit board 106 and oriented perpendicularly to the circuit board 106. In this case, the antenna 50 is oriented perpendicular to the ground plane 80 and generally parallel or coplanar to the circuit board 106. In either case, the antenna 50 is preferably spaced less than approximately ten (10) mm, and preferably less than six (6) mm from the ground plane 80.

It is important that the antenna 50 be disposed generally perpendicular to the ground plane 80. When the antenna 50 is disposed parallel to the ground plane 80 and the distance from the antenna 50 to the ground plane 80 is less than 5 mm, antenna 50 resonates at only one frequency. Disposing the antenna 50 generally perpendicular to the ground plane 80 allows a second resonance to be tuned, thereby permitting dual band operation.

FIGS. 3 and 4 illustrate the placement of the antenna 50 in relation to the other components of the mobile phone 10. The mobile phone 10 includes a housing 100 having a front cover 102 and a back cover 104. A printed circuit board 106 is positioned within the housing 100. The antenna 50 is positioned within housing 100 along one side of the printed circuit board 106. In conventional cellular telephones, the printed circuit board 106 acts as a ground plane for numerous electrical components positioned within the housing 100, and especially those components positioned on the printed circuit board 106. The antenna 50 of the present invention may also use the circuit board 106 of the phone as a ground plane 80 as shown in FIG. 3. In this case, the antenna 50 is oriented generally perpendicular to circuit board 106. However, this arrangement increases the thickness (compare for example FIGS. 3 and 4) of the mobile telephone. Alternatively, and more preferably, the ground plane 80 of the antenna may be positioned along one edge of the circuit board 106 and oriented perpendicularly to the circuit board 106. In this case, the antenna 50 is oriented perpendicularly to the ground plane 80 and generally parallel or coplanar to the circuit board 106. In either case, the antenna 50 is preferably spaced less than approximately ten (10) mm, and preferably less than six (6) mm from the ground plane 80.

Figure 5:
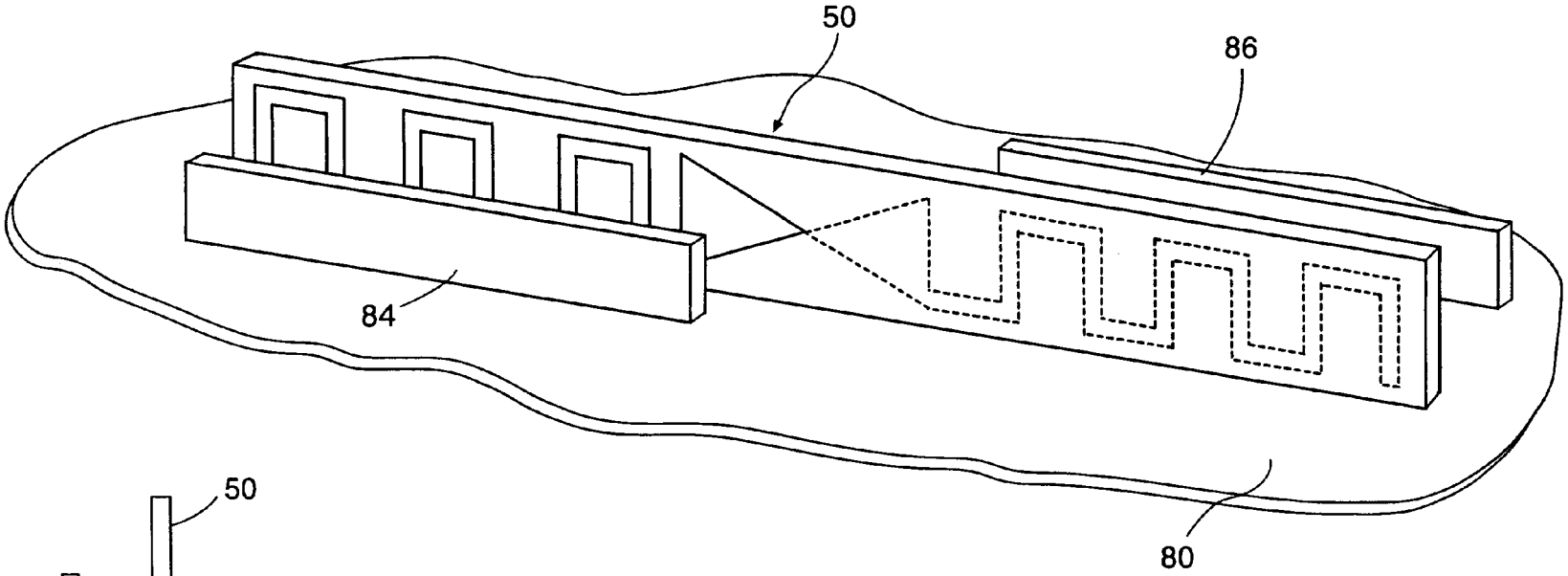
FIG. 5 is a perspective view of the antenna with parasitic tuning elements.
Figure 6:
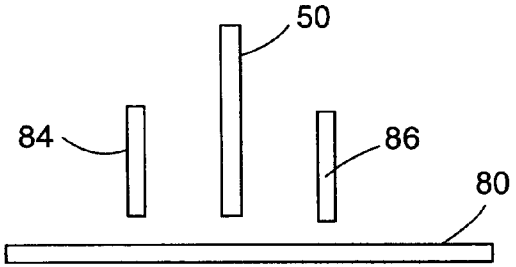
FIG. 6 is an end view of the antenna of FIG. 5.

FIGS. 5 and 6 are side and end views respectively of an antenna 50 that employs parasitic tuning elements. The antenna 50 is positioned over the ground plane 80 and a pair conductive parasitic tuning strips 84, 86 are positioned on opposing sides of the antenna 50. Since the parasitic tuning strips 84, 86 are spaced from the ground plane 80, a first capacitance is created between the ground plane 80 and the parasitic tuning strips 84, 86 and a second capacitance is created between the tuning strips 84, 86 and the antenna 50. Tuning is achieved by varying the distance between the parasitic tuning strips 84, 86 and the antenna 50 as well as varying the size of the parasitic tuning strips 84 and 86. The larger the parasitic tuning strips 84, 86, the greater the capacitive coupling to the ground plane 80. Likewise, moving the tuning strips 84, 86 closer to the ground plane 80 increases the capacitive coupling as does moving the tuning strips 84, 86 closer to the antenna 50. Typically, the parasitic elements are spaced approximately 0.5 mm to 2 mm from the ground plane 80 and approximately 0 mm to 2 mm from the antenna 50. While FIG. 5 shows the tuning strips 84, 86 substantially equal in length to the resonating element 60 or ground element 70, the tuning strips 84, 86 may be shorter or longer than the radiating elements 60, 70 and may be of unequal length with respect to each other.

Figure 7:
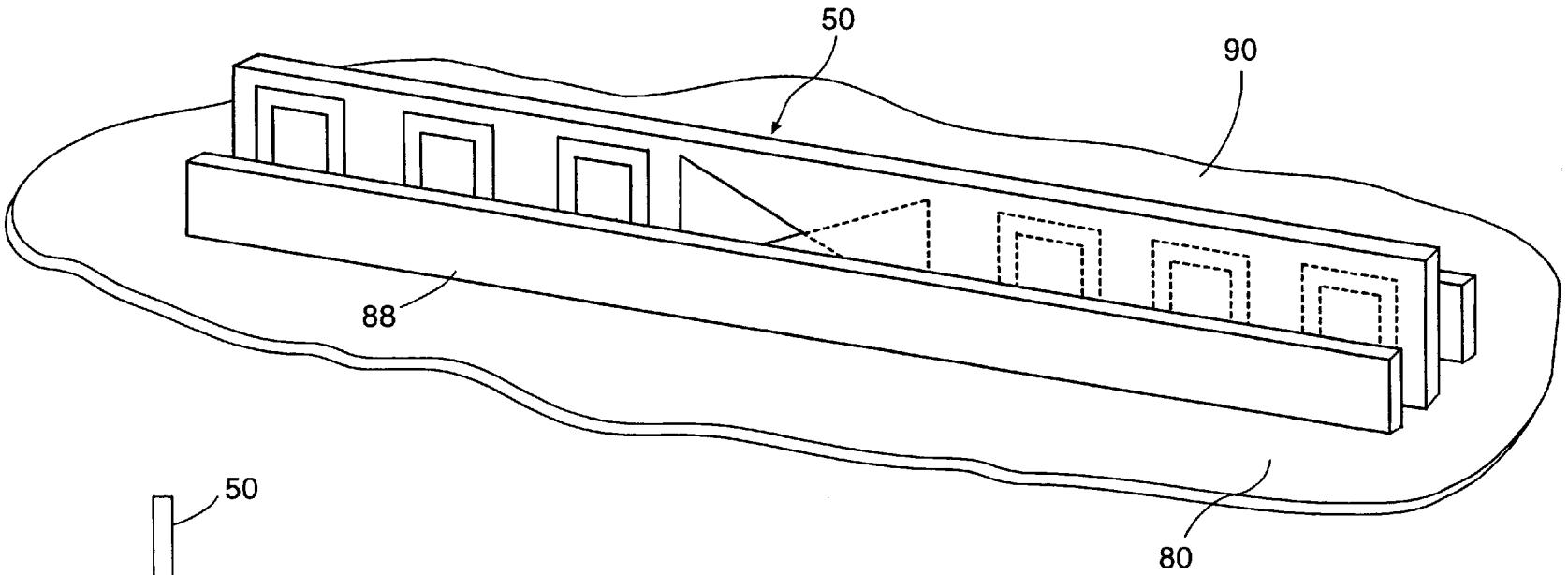
FIG. 7 is a perspective view of the antenna with parasitic tuning elements.
Figure 8:
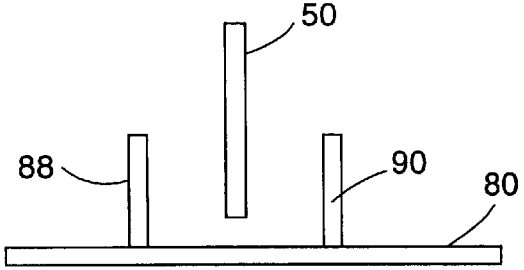
FIG. 8 is an end view of the antenna of FIG. 7.

FIGS. 7 and 8 show a pair of parasitic tuning strips 88 and 90 that are electrically connected to the ground plane 80 and thus no capacitance is developed therebetween. However, capacitive coupling does occur between the antenna 50 and the tuning strips 88 and 90. Again, varying the size of the tuning strips 88 and 90 varies the amount of capacitive coupling as does varying the distance between tuning strips 88, 90 and the antenna 50. While FIG. 7 shows the tuning strips 88, 90 extending essentially the whole length of the antenna 50, it is possible to shorten the tuning strips 88, 90 so that they are substantially less than the whole length.

A second tuning technique involves changing the geometry of the meanders 64, 74. By making the meander elements 64, 74 non-uniform in length, width, thickness, or shape, the effective electrical length of the antenna can be varied in both frequency bands.

Figure 9:
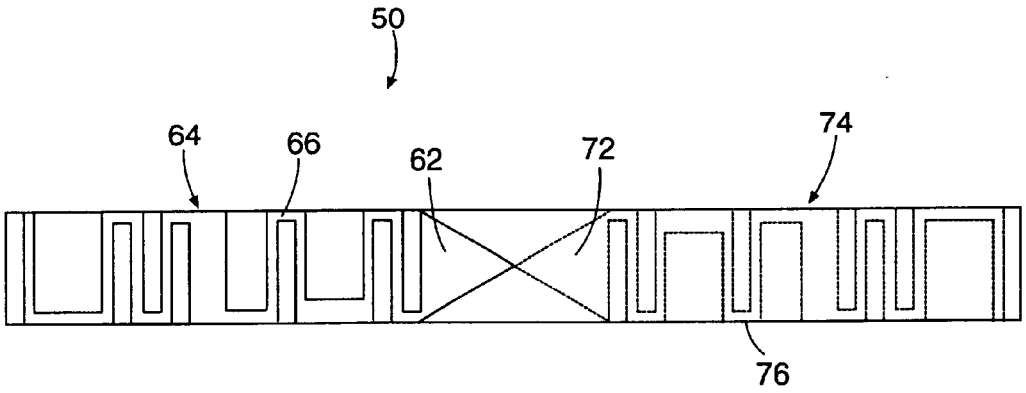
FIG. 9 is a side view of the antenna with non-uniform meanders.

FIG. 9 shows one embodiment of the antenna 50 having non-uniform meander elements are non-uniform to tune the antenna 50. In the embodiment shown in FIG. 9, the meander sections 64, 74 include segments of different widths and lengths. This variation in the width and length of the meander segments that comprise the meander section 64, 74 produces differing effects, all of which help to tune the antenna 50 to the desired frequencies. A narrow segment increases the resistance and thus the impedance of the oscillation 66 with the narrow segment. A wide segment lowers the impedance of the conductor, and is thus electrically shorter than narrow segments of the same length. As would be expected, lengthening the longitudinal segments increases the impedance. Also, lengthening the longitudinal segments that are disposed closest to the ground plane increases the capacitive coupling between the antenna 50 and the ground plane 80. Similarly, a relatively wide longitudinal segment adjacent the ground plane would also have an increased capacitive coupling with the ground plane 80.

Additionally, while the copper tape typically used as a meander section 64, 74 is of a fixed thickness, the thickness of the meander section 64, 74 be varied to achieve further tuning. The ability of varying the thickness of the meander section 64, 74 to tune is limited by the skin effect at the operative frequencies, but remains within the scope of the present invention.

Figure 10:
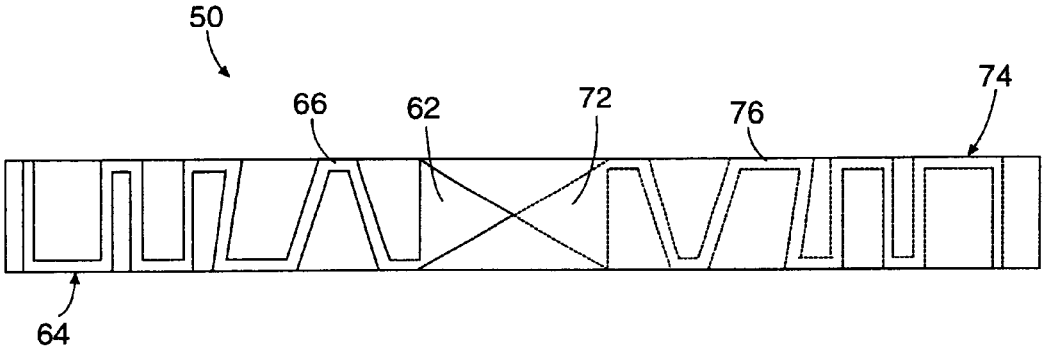
FIG. 10 is a side view of the antenna with asymmetric meanders of the second tuning technique.

FIG. 10 shows an antenna 50 wherein the oscillations 66, 76 are non-uniform in shape. In this technique, not only are the widths and lengths of the meander segments varied, but also the angles between adjacent segments is varied. For example, in FIG. 10, the meander sections 64, 74 includes triangular, trapezoidal, and rectilinear oscillations 66. The principle employed here is much the same as that used in FIG. 9. The more of each oscillation 64, 74 positioned close to the ground plane 80, the greater the capacitive coupling. The longer the path, the greater the inductance of the meander. Likewise, angling the portions relative to one another may create a little capacitance therebetween.

Figure 11:
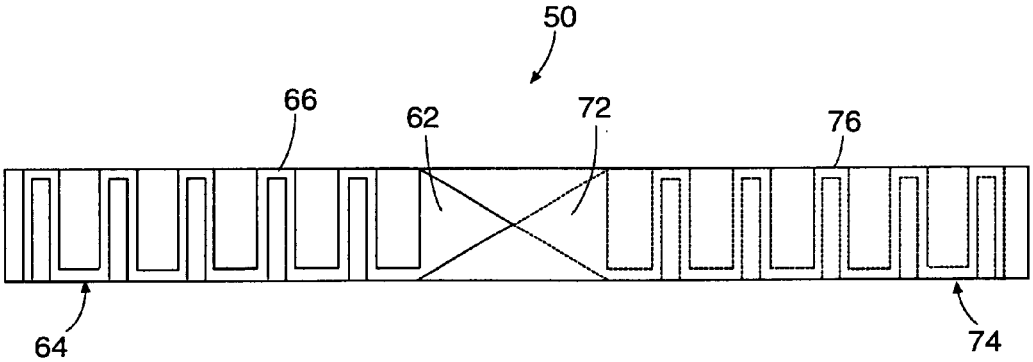
FIG. 11 is a side view of the antenna with meanders of varying length.

In FIG. 11, the physical path of the radiating elements of the antenna are made asymmetrical. As shown, ground element 70 is substantially shorter and includes fewer oscillations 76 than resonating element 60. It should be understood that resonating element 60 could be the shorter element. This technique again varies the capacitive coupling of the elements to the ground plane 80 as well as changing the length of the path seen by the electromagnetic signal. As would be expected, the shorter path results in a lower inductance.

The antenna 50 may also be tuned using other well-known techniques, such as varying the thickness of the dielectric substrate 52, changing the overall length or width of the antenna 50, changing the distance of the antenna 50 from the ground plane 80. Acceptable thickness of the dielectric substrate ranges from approximately 0.3 mm to one (1.0) mm and preferably 0.66 mm where the bandwidth is optimized. It should be noted that while it is preferred to vary the thickness uniformly, it is possible that additional tuning could be achieved through a non-uniform variation in the thickness of the dielectric substrate 52. This is not preferred however, because it would be difficult to machine a dielectric material which had a non-uniform thickness.

Combinations of the above described techniques may also be used to provide the desired tuning, however, they were treated distinctly for clarity in explaining each embodiment of each technique. It has been found that the antenna 50 can be tuned for dual band operations by using the tuning techniques described above. Ideally, the antenna should be tuned to obtain a standing wave ratio (VSWR) less than or equal to 2:1 in two or more frequency bands of operation.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed:

1. A dipole antenna for a mobile communication device comprising:

a) a planar dielectric substrate having first and second opposing surfaces and oriented generally perpendicularly to a ground plane disposed within a housing of the mobile communication device;

b) a first radiating element on said first opposing surface of said dielectric substrate;

c) a second radiating element on said second opposing surface of said dielectric substrate; and d) wherein said first and second radiating elements each include a bowtie element disposed in a central portion of the dielectric substrate.

2. The dipole antenna of claim 1 wherein said first and second radiating elements further include meander elements extending in opposite directions along a longitudinal axis of said dielectric substrate from said bowtie elements.

3. The dipole antenna of claim 1 wherein each said radiating element includes a meander element extending along a longitudinal axis of said dielectric substrate from a center portion of the dielectric substrate towards an end of said dielectric substrate.

4. The dipole antenna according to claim 3 wherein said meander elements include one or more oscillations that oscillate about said longitudinal axis.

5. The dipole antenna according to claim 4 wherein said oscillations are generally rectangular in form.

6. The dipole antenna of claim 3 wherein said meander elements are non-uniform.

7. The dipole antenna according to claim 6 wherein the meander element includes a plurality of meander segments of varying width.

8. The dipole antenna according to claim 7 wherein the meander elements include a first meander segment disposed below said longitudinal axis and a second meander segment disposed above said longitudinal axis, and wherein said first meander segment is wider than said second meander segment.

9. The dipole antenna according to claim 6 wherein said meander elements include a plurality of oscillations, and wherein said oscillations vary in shape.

10. The dipole antenna according to claim 6 wherein said meander elements include a plurality of oscillations, and wherein said oscillations are unevenly spaced along the length of said meander elements.

11. The dipole antenna of claim 1 wherein the longitudinal axis of the radiating elements is parallel to said ground plane.

12. The dipole antenna according to claim 1 wherein said radiating elements are asymmetrical.

13. The dipole antenna according to claim 1 wherein said first and second radiating elements are of different electrical lengths.

14. The dipole antenna according to claim 1 wherein said antenna resonates in at least two frequency bands.

15. The dipole antenna according to claim 1 further including at least one parasitic tuning element disposed generally parallel to said dielectric substrate.

16. The dipole antenna according to claim 15 wherein said parasitic tuning element comprises a planar conductive element in parallel spaced relation to said dielectric substrate.

17. The dipole antenna according to claim 16 wherein said parasitic tuning element is spaced from said ground plane.

18. The dipole antenna according to claim 16 wherein said parasitic tuning element is electrically connected to said ground plane.

19. A mobile communications terminal comprising:

a) a radio communications circuit;

b) a ground plane operatively coupled to said radio communications circuit;

c) a dipole antenna comprising first and second radiating elements operatively coupled to said radio communications circuit for receipt and transmission of radio signals, said first and second radiating elements each comprising a bowtie element, said antenna oriented generally perpendicular to said ground plane; and d) wherein said first and second radiating elements are disposed on opposite sides of a dielectric substrate.

20. The mobile communication device of claim 19 wherein each of said bowtie elements is disposed in a central portion of the dielectric substrate.

21. The mobile communication device of claim 20 wherein said first and second radiating elements further include meander elements extending in opposite directions along a longitudinal axis of said dielectric substrate from said bowtie elements.

22. The mobile communication device of claim 19 wherein each said radiating element includes a meander element extending along a longitudinal axis of said dielectric substrate from a center portion of the dielectric substrate towards an end of said dielectric substrate.

23. The mobile communication device according to claim 22 wherein said meander elements include one or more oscillations that oscillate about said longitudinal axis.

24. The mobile communication device according to claim 23 wherein said oscillations are generally rectangular in form.

25. The mobile communication device of claim 22 wherein said meander elements are non-uniform.

26. The mobile communication device according to claim 25 wherein the meander element includes a plurality of meander segments of varying width.

27. The mobile communication device according to claim 26 wherein the meander elements include a first meander segment disposed below said longitudinal axis and a second meander segment disposed above said longitudinal axis, and wherein said first meander segment is wider than said second meander segment.

28. The mobile communication device according to claim 25 wherein said meander elements include a plurality of oscillations, and wherein said oscillations vary in shape.

29. The mobile communication device according to claim 25 wherein said meander elements include a plurality of oscillations, and wherein said oscillations are unevenly spaced along the length of said meander elements.

30. The mobile communications terminal according to claim 19 wherein the longitudinal axis of the radiating elements is parallel to said ground plane.

31. The mobile communication device according to claim 19 wherein said radiating elements are asymmetrical.

32. The mobile communication device according to claim 19 wherein said first and second radiating elements are of different electrical lengths.

33. The mobile communication device according to claim 19 wherein said antenna resonates in at least two frequency bands.

34. The mobile communications device according to claim 19 further including a parasitic tuning element.

35. The mobile communications device according to claim 34 wherein said tuning element is at least one planar conductor positioned perpendicular to said ground plane.

36. The mobile communication device according to claim 35 wherein said planar conductor is spaced from said ground plane.

37. The mobile communications device of claim 35 wherein said planar conductor is electrically connected to said ground plane.

38. The mobile communications device of claim 19 further including a circuit board containing said radio communications circuits.

39. The mobile communications device of claim 38 wherein said ground plane is disposed perpendicular to said circuit board.

40. The mobile communications device of claim 38 wherein said circuit board contains said ground plane.

* * * * *